United States Patent [19]

Shimirak et al.

[11] Patent Number: 5,069,636

[45] Date of Patent: Dec. 3, 1991

[54] TERMINAL BLOCK AND ADAPTER

[75] Inventors: Gerald L. Shimirak, Danville; Paul S. Chan, San Francisco, both of Calif.; John Kay, Swindon, United Kingdom; Jim Croce, Willow Springs; Van L. Huynh, Garner, both of N.C.; John Swinmurn, Los Altos, Calif.; Eric Bierlein, Cary, N.C.

[73] Assignee: Raychem Corporation, Menlo Park, Calif.

[21] Appl. No.: 601,023

[22] Filed: Oct. 23, 1990

Related U.S. Application Data

[63] Continuation of Ser. No. 462,173, Jan. 8, 1990, abandoned, which is a continuation-in-part of Ser. No. 270,411, Nov. 7, 1988, abandoned, which is a continuation of Ser. No. 130,347, Dec. 8, 1987, abandoned, which is a continuation-in-part of Ser. No. 102,072, Sep. 29, 1987, abandoned, which is a continuation-in-part of Ser. No. 70,475, Jul. 7, 1987, abandoned.

[51] Int. Cl.[5] ..... H01R 4/24

[52] U.S. Cl. ..... 439/412

[58] Field of Search ..... 439/411–413, 439/416

[56] References Cited

U.S. PATENT DOCUMENTS

| | | | |
|---|---|---|---|
| 619,263 | 2/1899 | Bachmann . | |
| 634,766 | 10/1899 | Roche . | |
| 1,005,199 | 10/1911 | Gugler . | |
| 1,570,722 | 1/1926 | Baldwin . | |
| 1,633,176 | 6/1927 | Goeller . | |
| 1,635,351 | 7/1927 | Spurgeon . | |
| 1,791,470 | 2/1931 | Runkle . | |
| 1,924,334 | 8/1931 | Tauber . | |
| 1,951,591 | 3/1934 | Anzalone et al. | 173/259 |
| 1,980,893 | 11/1934 | Walde | 173/259 |
| 2,078,825 | 4/1937 | Wisner | 439/412 |
| 2,434,475 | 1/1948 | Sullivan | 173/259 |
| 2,551,895 | 5/1951 | Noir | 173/259 |
| 2,613,287 | 10/1952 | Geiger | 200/1 |
| 2,700,142 | 1/1955 | Benander | 439/413 |
| 2,911,615 | 11/1959 | Popejoy et al. | 339/198 |
| 3,129,048 | 4/1964 | Broch | 339/97 |
| 3,223,959 | 12/1965 | Abbott, Jr. | 339/94 |
| 3,351,885 | 11/1967 | Baldwin et al. | 339/74 |
| 3,588,787 | 6/1971 | Kindell et al. | 339/95 |
| 3,602,871 | 8/1971 | Newman | 339/22 B |
| 3,775,730 | 11/1973 | Rowls et al. | 339/60 C |
| 3,784,964 | 1/1974 | Newman et al. | 339/219 R |
| 3,860,314 | 1/1975 | Vandiveer et al. | 339/18 R |
| 3,864,003 | 2/1975 | Boke | 339/198 R |
| 3,930,706 | 1/1976 | Obuch et al. | 339/64 R |
| 4,123,132 | 10/1978 | Hardy et al. | 339/246 |
| 4,145,107 | 3/1979 | De Haitre | 339/263 R |
| 4,146,289 | 3/1979 | Kirrish | 339/95 |
| 4,153,323 | 5/1979 | Wildi et al. | 339/95 |
| 4,340,268 | 7/1982 | Scalera | 339/18 R |
| 4,446,332 | 5/1984 | Dauser, Jr. | 174/87 |
| 4,483,910 | 11/1984 | Julian | 429/179 |
| 4,595,635 | 6/1986 | Dubrow . | |
| 4,652,071 | 3/1987 | DeBortoli et al. | 439/412 |
| 4,734,061 | 3/1988 | Randall, Jr. et al. | 439/709 |

FOREIGN PATENT DOCUMENTS

| | | | |
|---|---|---|---|
| 15469 | 12/1933 | Australia . | |
| 0067917 | 12/1982 | European Pat. Off. . | |
| 0108518 | 5/1984 | European Pat. Off. . | |
| 0298713 | 1/1989 | European Pat. Off. . | |
| 2206187 | 8/1972 | Fed. Rep. of Germany . | |
| 711240 | 9/1931 | France | 12/5 |
| 844804 | 8/1939 | France | 12/6 |
| 251655 | 7/1925 | Italy . | |
| WO89/08338 | 9/1989 | PCT Int'l Appl. . | |
| 2083293 | 3/1982 | United Kingdom . | |

*Primary Examiner*—Joseph H. McGlynn

*Attorney, Agent, or Firm*—A. Stephen Zavell; Herbert G. Burkard

[57] ABSTRACT

This invention provides a terminal block or an adaptor where the binding posts and the caps which screw on the binding posts are adapted to receive small wires without breaking or cutting the wires when the cap is installed with normal installation torque for binding posts. The binding posts and cap can also receive large gauge wires and make connection therewith through the insulation on the wire without cutting or braking the conductor in the wire.

24 Claims, 8 Drawing Sheets

TERMINAL BLOCK AND ADAPTER

RELATED APPLICATIONS

This application is a continuation of application Ser. No. 07/462,173, filed Jan. 8, 1990, now abandoned, which is a continuation-in-part of our application Ser. No. 270,411 filed Nov. 7, 1988, now abandoned, which is a continuation of application U.S. Ser. No. 130,347 filed Dec. 8, 1987, now abandoned, which is a continuation-in-part of Ser. No. 102,072 filed Sept. 29, 1987, now abandoned, which is in turn a continuation-in-part of copending application U.S. Ser. No. 070,475 filed July 7, 1987, now abandoned, the disclosures of each of which are fully and completely incorporated herein by reference for all purposes.

FIELD OF THE INVENTION

This invention relates to terminal blocks and adaptors for connecting wires to binding posts, particularly for connecting telecommunications drop wires to telecommunications cables or other equipment. In particular, a first embodiment of this invention relates to modular terminal blocks suitable for attaching telecommunication drop wires to binding posts in terminals blocks which are in turn connected to telecommunication cables or other equipment. In a second embodiment, the invention relates to adaptors for use on prior art terminal blocks which require striping of insulation from wires before connection to binding posts where they were secured with a washer and simple nut.

BACKGROUND OF THE INVENTION

Various configurations of terminal blocks have been used in the telecommunications industry which typically require the stripping of the drop wires before attaching the drop wires to the binding posts in the terminal block. An example of such terminal blocks is the Western Electric 9Al which typically contains 5, 10 or more pairs of binding posts for attaching drop wires or service wires. In other configurations such as the TII Model 325, the terminal block may also contain circuit protection devices. These existing terminal blocks in use in the telecommunications industry require that the ends of the drop wires or service wires be stripped of insulation before connection to the desired binding post with conventional nuts and washers. In addition, the binding posts and the stripped portion of the drop wire or service wire are left exposed to moisture, corrosion, insects and other environmental factors which interfere with the reliability of the electrical connection intended between the drop wires or service wires and the terminal block binding posts. Other types of terminal blocks contain insulation-displacement type connections which causes the wires to break or corrode.

This invention can provide an improved device such as a modular terminal block or adaptor which allows the worker to make a connection between a wire and binding post without prestripping the insulation from the wire.

This invention can also provide an improved terminal block or adaptor that prevents corrosion or other damage of the wire connected to the binding post.

This invention can also provide an access port for testing the connection made between the wire and the binding post.

This invention can also provide a modular terminal block having improved visibility and ease of use for the worker connecting the wire to the binding post.

This invention also provides an adaptor that allows connection to be made between an insulated wire and a binding post with no risk of damage to the wire.

SUMMARY OF THE INVENTION

The present invention provides a device for electrically connecting an insulated wire to a binding post, which comprises:

(a) an insulative housing having an opening through which a binding post may pass and having another opening through which the insulated wire may pass such that the wire extends into the first-mentioned opening; and (b) a cap having a conductive inner portion that may be received by the binding post to bring the cap into the first mentioned opening, the cap having bottom edge means that engages a conductor of the wire by passing through insulation of the wire when the cap is thus received by the binding post; and (c) means that limits the extent to which the cap can be received by the binding post thereby preventing the conductor being broken or severed by the bottom edge means.

In a first preferred embodiment, this invention provides a terminal block for connecting insulated wires to binding posts comprising:

an insulative housing containing a plurality of spaced apart conductive binding posts;

conductive binding posts having opening means therein for receiving the insulated wire; and caps on the binding posts; wherein:

the insulative housing has first opening means therein aligned with the opening means in the binding posts whereby an insulated wire is received through the opening in the housing and into the opening in the binding posts; and the binding posts have thread means for engaging a threaded cap and have first shoulder means positioned between the thread means and the opening means for engaging opposing shoulder means in the cap and have second shoulder means positioned on the opposite side of the opening means which second shoulder means is adapted for supporting the wire when pressure is applied to the wire by the cap threaded onto the binding posts; and the caps have a conductive inner portion and an insulative outer portion wherein the conductive inner portion has thread means adapted to engage the thread means on the binding posts and has shoulder means at the end of said thread means for engaging the first shoulder means of the binding posts and has bottom edge means for engaging the wire positioned in the opening means of the binding posts and compressing the wire against the second shoulder means of the binding posts as the cap is tightened on the binding posts whereby the edge means contacts a conductor in the wire by passing through the insulation on the wire;

wherein the distance between the shoulder means in the cap and the edge means of the cap is such that when the shoulder means in the cap seats against the first shoulder means of the binding posts the distance between the edge means of the cap and the second shoulder means of the binding post is a preselected distance which allows connection of the edge means of the cap through the insulation of the wire to a conductor in the wire without breaking or servering the wire; and wherein the housing has second opening means positioned substantially at right angles to said wire receiving openings through which second opening means the binding posts extend and adapted for receiving the caps therethrough.

In a second preferred embodiment, the invention provides a terminal block adaptor for connecting an insulated wire to a conductive binding post of a terminal block comprising in combination an insulative collar and a threaded cap wherein:

the collar comprises (a) a first opening means therethrough which is smaller in one portion for receiving the binding post from one side of the collar and is larger in another portion for receiving the cap from the opposing side of the collar thereby forming a shoulder in the first opening means proximate to the bottom of the cap when installed whereby the threads in the cap can engage the threads on the binding post and (b) a second opening means in a lateral side thereof, communicating with the first opening means and being positioned laterally opposite from the position of the binding post received in the first opening means, for receiving an insulated wire whereby the wire is positioned by the second opening means at least in part adjacent the binding post and underneath the cap and is engaged by the cap when the cap is threaded on the binding post; and the cap comprises a conductive inner portion and an insulative outer portion wherein the conductive inner portion has thread means adapted to engage the thread means on the binding post and has bottom edge means for engaging the wire positioned in the second opening means of the collar and adjacent the binding post and for compressing the wire against the shoulder means in the first opening means as the cap is tightended on the binding post whereby the edge means contacts a conductor in the wire by passing through the insulation on the wire; and wherein the collar and cap contain cooperative stop means for stopping the advance of the cap on the binding post at a preselected distance between the edge means of the cap and at least the portion of the shoulder means against which the wire is compressed, thereby allowing connection of the edge means of the cap through the insulation of the wire to a conductor in the wire without breaking or severing the wire.

DESCRIPTION OF FIRST PREFERRED EMBODIMENT

The terminal block preferably has edge means of the cap positioned at an appropriate distance form the shoulder means in the cap and has an appropriate configuration whereby when the shoulder in the cap engages the first shoulder means of the terminal posts the edge means of the cap makes contact through the insulation to the conductor in a wire of a minimum predetermined size and whereby the edge portion of the cap can engage a conductor in a larger wire through the insulation thereof by compressing the wires against the second shoulder means of the binding posts without servering the wire and without the shoulder means in the cap engaging the first shoulder means of the binding posts when the larger wire is present.

Openings in the housing of the terminal block preferably contain a sealant material (preferably a gel) which is placed under compressive force when the wire is inserted into the opening means in the housing and binding posts and the cap means is advanced against the wire to make connection with a conductor in the wire.

The cap of the terminal block preferably has conductive means connected with the inner conductive portion which conductive means is accessible through an opening in the outer insulative portion of the cap to provide access for test probe for testing the connection made by the cap.

The housing of the terminal block preferably has a base adapted for mounting on a substrate and wherein the binding posts and associated openings in the housing are positioned at an angle of at least 20° from normal to the base to thereby facilitate visibility by the worker when inserting the wires into the opening means.

DESCRIPTION OF SECOND PREFERRED EMBODIMENT

The terminal block adapter preferably has cooperative stop means comprising a shoulder on the cap which engages an outside surface of the collar.

The terminal block adapter preferably has cooperative stop means comprising a portion of the shoulder means in the first opening means which engages the edge means of the cap thereby leaving the desired preselected distance between the edge means of the cap and another portion of the shoulder means where the wire is positioned between the cap and the shoulder means.

The terminal block adapter preferably has a sealing material (preferably a gel) in at least one of the opening means for environmentally sealing the wire, binding post, or cap.

The terminal block adapter preferably has a test port for communicating with the conductive inner portion thereof for testing of electrical continuity of the cap and posts with the wire.

BRIEF DESCRIPTION OF THE DRAWINGS

FIG. 1 shows a conventional terminal block 1 which contains pairs of threaded binding posts 2. In conventional use wires 3 are striped of insulation at the end and the wire wrapped around binding posts 2 and held in place by washers 4 and threaded nut 5.

DESCRIPTION OF THE DRAWINGS OF THE FIRST PREFERRED EMBODIMENT OF THE INVENTION

Figure 1:
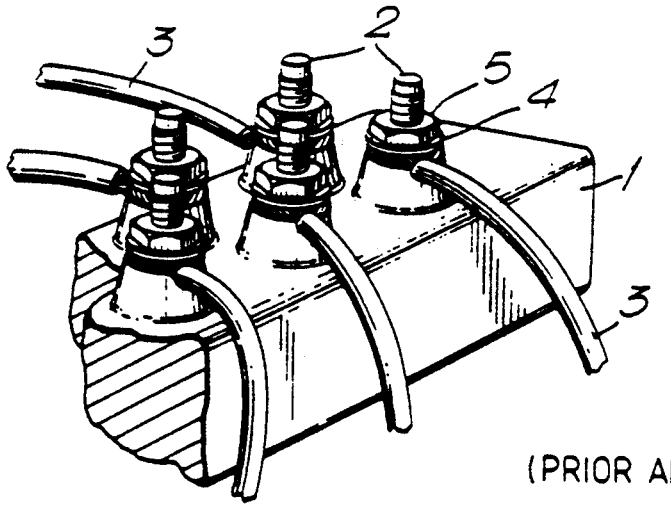
FIG. 1 is an illustration of the prior art 91A terminal block.
Figure 2:
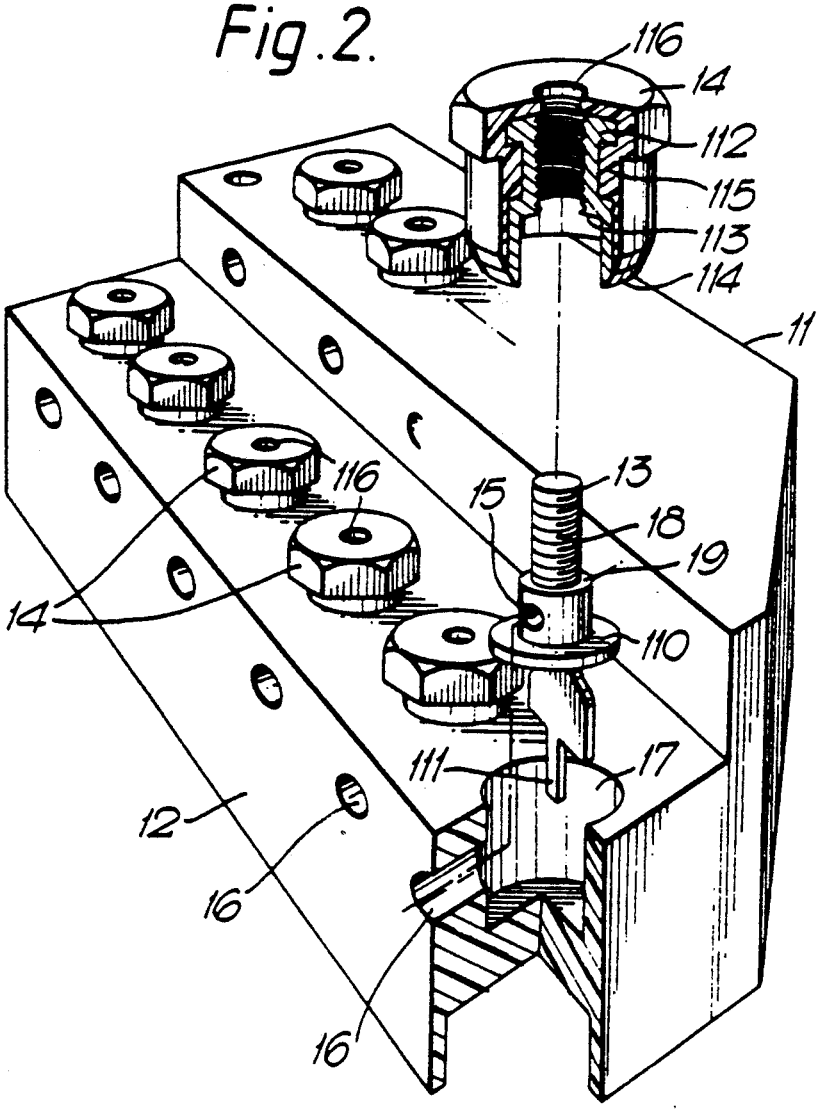
(PRIOR ART) Fig. 2.
FIG. 2 shows a perspective partially cut away exploded view of the terminal block of the first preferred embodiment of the present invention.

FIG. 2 shows one configuration of a five pair terminal block having two banks of binding posts configured for three pairs in the bottom tier and two pairs in the upper tier. Terminal block 11 comprises a housing 12, binding posts 13 and caps 14. Openings 15 in the binding posts are aligned with openings 16 in housing 12 whereby the wire intended to be connected to the binding posts can be inserted through opening 16 and received into opening 15 in the binding posts. It is preferred that the opening 15 extend all the way through the binding posts so that the wire may be inserted completely through binding posts 13 until it abuts against the wall of cavity 17 in housing 12. Binding post 13 has threaded portion 18 and shoulder means 19 positioned between threaded portion 18 and opening 15. Binding post 13 has second shoulder means 110 for supporting the wire when compressed by the cap. The bottom portion 111 of binding post 13 can be of any conventional or desired configuration for interconnection with the desired component. For example, portion 111 may be connected to a wire tail which is in turn spliced to a cable. Alternatively, portion 111 may be an opening for interconnecting with other electronic or electric components such as circuit protection devices or disconnect devices.

The cap 14 contains an inner conductive portion 112 which is threaded for engagement with the threaded portion 18 of binding post 13. The inner conductive portion of the cap has shoulder means 113 adapted for engaging shoulder means 19 on binding post 13. The inner conductive portion 112 of cap 14 has edge portion 114 adapted for engaging the wire and compressing the wire against second shoulder means 110 of binding post 13. The inner conductive portion 112 of cap 14 is covered by outer insulative portion 115. The outer portion 115 of cap 14 may be solid for full enclosure or may contain preferred access port 116 for test probe access to either the conductive inner portion 112 of cap 14 or the top of binding post 13. A preferred configuration is where conductive portion 112 of cap 14 is completely enclosed across the top and opening 116 in cap 14 provides test probe access to the top of conductive portion 112 of cap 14.

In another preferred configuration, cavity 17 is filled with a sealing material to provide a barrier to moisture entry and to prevent corrosion of the binding post and the wire. The sealing material is preferably a gel material having a cone penetration in the range of about 100 to about 350 (10-1 mm) and an ultimate elongation of at least 200%. Such preferred sealing materials are disclosed in U.S. Pat. Nos. 4,600,261 and 4,634,207 to Debbaut.

Figure 3A:
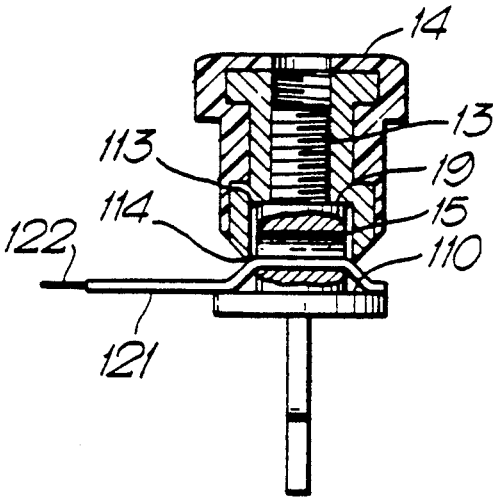
FIGS. 3*a*, and 3*b* show side views of the binding post and cap of the terminal block of the first preferred embodiment of the present invention with a wire assembled therein.
Figure 3B:
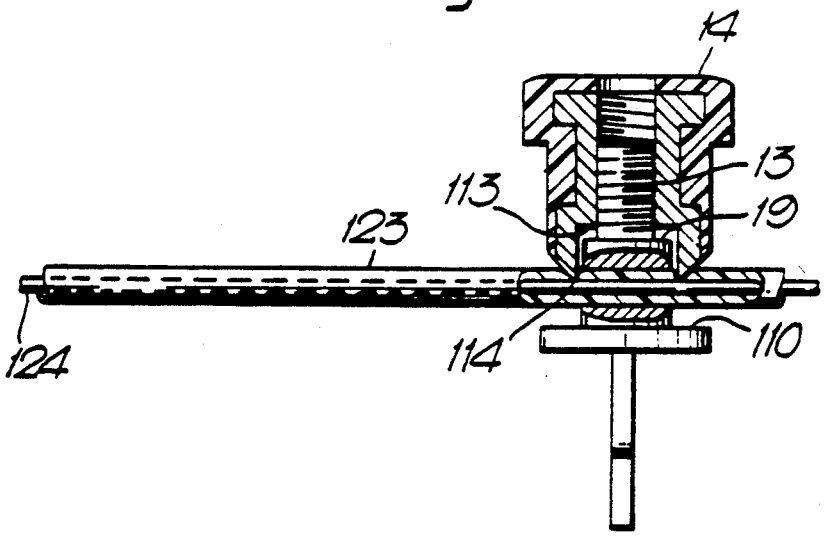

FIGS. 3*a* and 3*b* show the installation of a binding post and terminal cap of this invention on a minimum predetermined size of wire and on a larger wire. In FIG. 3A cap 14 is screwed down on terminal post 13 whereby the small wire 121 extending through opening means 15 is deformed by edge means 114 of cap 14 whereby edge means 114 makes contact with conductor 122 of wire 121 through the insulation of wire 121. FIG. 3A also illustrates how shoulder means 113 in cap 14 engages shoulder means 19 of binding post 13 to thereby stop the advance of cap 14 on binding post 13 before the conductor 122 in wire 121 is severed. As will be apparent to one skilled in the art, the selection of dimensions of the distance between edge means 114 of the cap and shoulder means 113 as well as the dimension between the bottom of opening means 15 and shoulder means 19 of binding post 13 as well as the distance between the bottom of opening means 15 and shoulder 110 of binding posts 13 will all be preselected depending upon the size of wire 121 and the size of conductor 122 in wire 121. These dimensions may also be affected by the lateral distance provided between the skirt of cap 14 and the outer surface of binding posts 13 between shoulder means 19 and shoulder means 110. The wider the gap between the skirt and consequently edge means 114 and the surface of that portion of binding post 13 will provide easier conformability of wire 121 when compressed against shoulder 110. The smaller the gap between the skirt and edge means 114 and binding post 13 will provide more likelihood that shear forces may cut or break wire 121 or conductor 122 before shoulder 113 of cap 14 is seated on shoulder 19 of binding post 13. Likewise the configuration of edge means 114 will be determined by the characteristics of the preselected wire 121 and conductor 122. If the insulation on wire 121 is hard or tough the edge means 114 may need to be sharp in order to cut through the insulation to make contact with conductor 122. In contrast, if the insulation on wire 121 is soft, edge means 114 may desirably be rounded so that it will pierce through the insulation on wire 121 and make contact with conductor 122 without cutting conductor 122.

FIG. 3*b* illustrates the assembly of a larger wire 123 with larger conductor 124 assembled in a binding post 13 and cap 14. As can be seen in this illustration, edge means 114 has engaged conductor 124 of wire 123 but shoulder means 113 has not contacted or seated on shoulder means 19. In this use with the larger wire, it can be seen that the configuration of edge means 114, the distance between the skirt of the cap and edge means 114 from the binding post 13 should be designed such that the edge means 114 will not cut or break conductor 124 when the usual torque is applied by the worker in installing cap 14 on binding post 13. Although not shown in FIG. 3*b*, it is generally preferred that the skirt diameter and edge means 114 diameter compared to the binding posts diameter as well as the shape of edge means 114 are such that conductor 123 will be deformed by the downward pressure of cap 14 against shoulder 110 of binding post 13 for the best holding power to prevent wire 123 from being pulled out of the binding post and cap assembly.

The binding post and cap configuration of the present invention provides a number of advantages among which are the following. Edge means 114 of the cap may be configured in a very round shape rather than a cutting edge shape because when edge means 114 contacts the wire 121 or 123 and deforms the wire against shoulder 110 placing the wire under compression a rounded edge means can easily pass through even tough insulation because of the rotational movement of cap 14 in order to make contact with wire 122 or wire 124 while the rounded edge will not be likely to cut or break the conductor 122 or 124 in the wires. Such a rounded configuration of edge 114 is less likely to cause a nick or notch in the conductor of the wire which would weaken it structurally and increase the likelihood that the wire would break at that point. Therefore improved surface life of wires is one advantage of the terminal block in the present invention. Other features include the fact that cap 14 can be backed off to open or disconnect the circuit and provide testing capability to isolate sources of problems in the circuit without moving the wire. After testing, the connection can be restored by rotating the cap back into position so that edge means 114 is in contact with the conductor in the wire.

Figure 4:
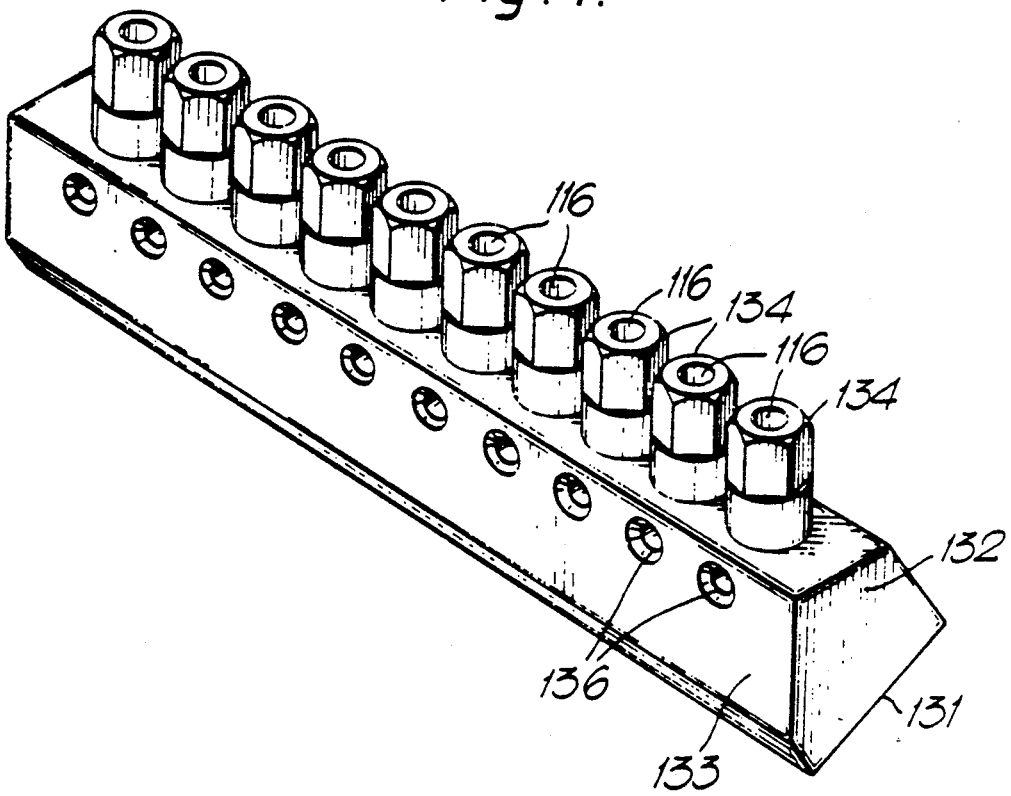
FIG. 4 shows a perspective view of a preferred configuration of the terminal block of the first preferred embodiment of the present invention.

FIG. 4 shows a preferred configuration of the terminal block of the present invention wherein housing 132 contains a single tier of terminal posts and caps. Illustrated in FIG. 4 is a five pair terminal block having openings 136 in housing 132 for receiving the wires which are desired to be connected with the terminal posts inside housing 132. Caps 134 contain openings 116 for test access to either the conductive inner portion of caps 134 or to the binding posts on which caps 134 are mounted. Base 131 of housing 132 is adapted for attachment to either horizontal or vertical substrates or can be adapted to be plugged into other components. The angle at which the face 133 is positioned provides easier visual access for the worker to install the desired wires in openings 136. The angle at which caps 134 are positioned (essentially perpendicular to face 133) provides easy access for the worker to turn the caps with conventional tools.

Figure 5:
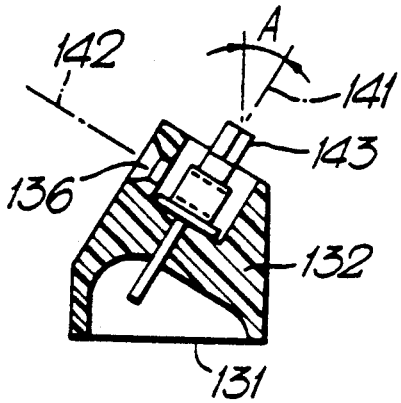
FIG. 5 shows a cross-section end view of a preferred configuration of the housing of the terminal block of the first preferred embodiment of the present invention.

FIG. 5 is a cross-section end view of the preferred embodiment shown in FIG. 4 and illustrates that the longitudinal axis 141 of binding posts 143 may be positioned at any desired angle, A, preferably between about 20° and 60° from the vertical. In general, it is preferred that the axis 142 of the openings in the housing and the binding posts in general be perpendicular to axis 141 but these may be positioned at different angles as desired for different applications.

Figure 6:
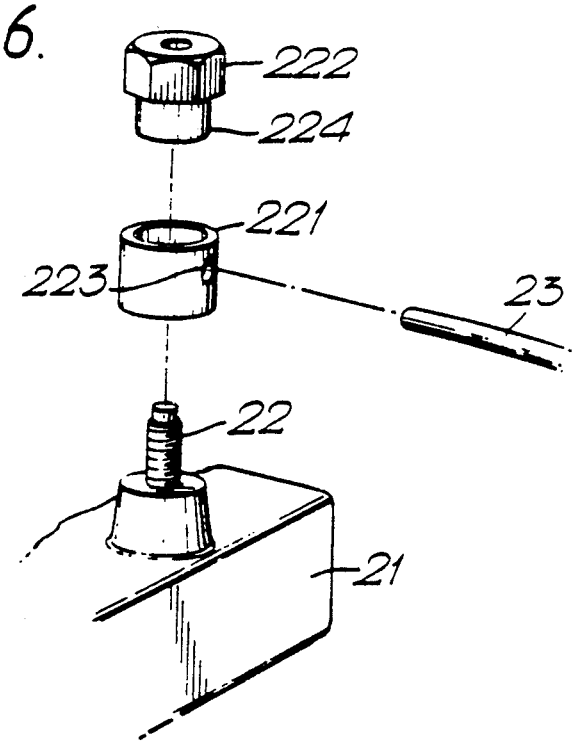
FIG. 6 is an exploded view of the collar and cap of the adaptor of the second preferred embodiment of the present invention to be assembled on a binding post of a terminal block.

Description of the Drawings of the Second Preferred Embodiment of the Invention FIG. 6 illustrates the basic elements of the terminal block adapter of the present invention which comprises collar 221 and cap 222 which are for use on conventional terminal block 21 and threaded binding post 22. It will be noted that in actual use the conventional washers 224 and nuts 222 will preferably be removed from the binding posts and discarded and wire 23 will preferably be cut at the end to provide a straight section of wire with the insulation on the wire for insertion into the collar of the terminal block adapter of the present invention. In use the terminal block adapter of the present invention involves placing collar 221 on binding post 22 inserting wire 23 into the opening 223 in collar 221 then placing cap 222 into collar 221 and engaging threads in cap 222 on the threads of binding post 22 and tightening cap 222 down on binding post 22 until the bottom edge 224 of cap 222 engages the insulation and cuts through the insulation of wire 23. Cap 222 thus makes the connection through insulation of wire 23 to the conductor in wire 23 through the conductive portion of the cap 222 at edge 224 to binding post 22.

Figure 7:
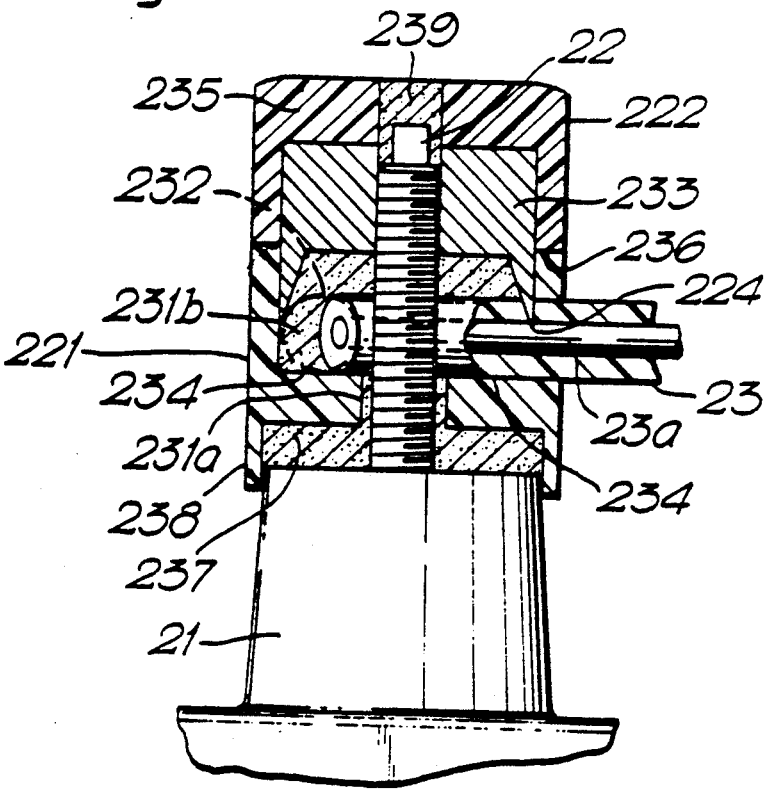
FIG. 7 is a cross-section view of the adapter of the second preferred embodiment of the present invention as assembled on the terminal block binding post.

In FIG. 7 the details of the terminal block adapter of the present invention can be more clearly understood. Collar 221 has a first opening means **231*a* which is small in one portion for the binding posts to pass therethrough and is larger in portion 231*b* for receiving the bottom of the cap 222. Collar 221 contains a second opening 232 extending from the lateral side of the collar into the larger portion 231*b* of the first opening whereby opening 232 is adapted to receive the insulated wire from the lateral side of the collar 221. Cap 222 comprises an inner conductive portion 233 which has lower edge 224 adapted for engaging the wire and cutting through the insulation of the wire to engage the conductor 23*a* in wire 23, and outer insulative portion 235. The conductive inner portion 233 of cap 222 is threaded to engage the binding post 22 and thereby make the electrical connection from the conductor 23*a* of wire 23 to binding post 22. Collar 221 contains a shoulder area 234 which is the bottom of the wider part of the first opening 231*b* in collar 221. Shoulder area 234 in collar 221 provides the base against which wire 23 is compressed by the bottom edge 224 of cap 222. Collar 221 and cap 222 contain cooperative stop means which stops the advance of bottom edge 224 so that edge 224 of the cap 222 does not server or cut too deeply into wire 23 and conductor 23*a*. Such cooperative stop means can be of various configurations and is illustrated in FIG. 7 by shoulder area 236 on cap 222 which engages the top surface of collar 221 whereby the distances from the top surface of collar 221 and shoulder 236 to the bottom edge 224 of cap 222 provides a predetermined distance between bottom edge 224 of cap 222 and shoulder means 234 in collar 221 against which wire 23 is compressed by bottom edge 224 of cap 222**.

Additional optional but preferred aspects of the terminal block adapted of this invention are illustrated in FIG. 7 wherein cavity 237 created by skirt 238 on collar 221 is filled with a sealing material which seals around the base of the binding posts 22. Likewise, openings **231*a*, 231*b* and 232 in collar 221 may be filled with a sealing material to thereby seal all of the void spaces around the wire and binding post. FIG. 7 also illustrates opening 239 and cap 222 which provides a test port to binding post 22 for testing electrical continuity from conductor 23*a* in wire 23 through the inner conductive portion 233 of cap 222 to binding post 22. As with the other parts of the terminal block adapter, port 239 may be filled with a sealing material and may contain any kind of protective cap or plug to environmentally protect the top of binding post 22**.

The sealing materials useful in the terminal block adapter of the present invention may be any conventional sealing material such as gels or greases. However, it is preferred that the sealing material be a gel as disclosed in U.S. Pat. Nos. 4,600,261, 4,634,207, 4,595,635.

Another configuration of the cooperative stop means, while not shown specifically in the drawings, can be understood by reference to FIG. 7. An alternative embodiments of the cooperative stop means can be made where the second opening 232 in collar 221 is recessed down in and partially below shoulder 234 whereby bottom edge 224 of cap 222 would engage at least a portion of shoulder 234 opposite opening 232 containing wire 23 thus halting the advance of cap 222 when edge 224 engages the higher portion of shoulder 234 which would occur after edge 224 of cap 222 had engaged wire 23 and passed through the insulation to contact conductor 23*a*. Various other configurations of the cooperative stop means will be apparent to those skilled in the art. Also with reference to FIG. 7 it will be apparent that opening 232 can be extended into the opposite side of collar 221 whereby wire 3 could extend further into opening 232 thereby allowing edge 224 to contact wire 23 on both sides of cap 222 rather than just one side.

As an alternative to the cooperative stop means requiring cooperation between some element of cap 222 and some element of collar 221, this invention may also utilize a unilateral stop means in cap 222 which comprises a shoulder similar to shoulder 236 which is a predetermined distance from the edge 224 of cap 222 whereby the shoulder would engage and rest on the flat surface of the insulation of wire 23 after edge 224 has cut through the insulation and engaged conductor 23*a*. Other configurations within the scope of the present invention will be apparent to one skilled in the art following the present disclosure and illustrations in the drawings.

Figure 8:
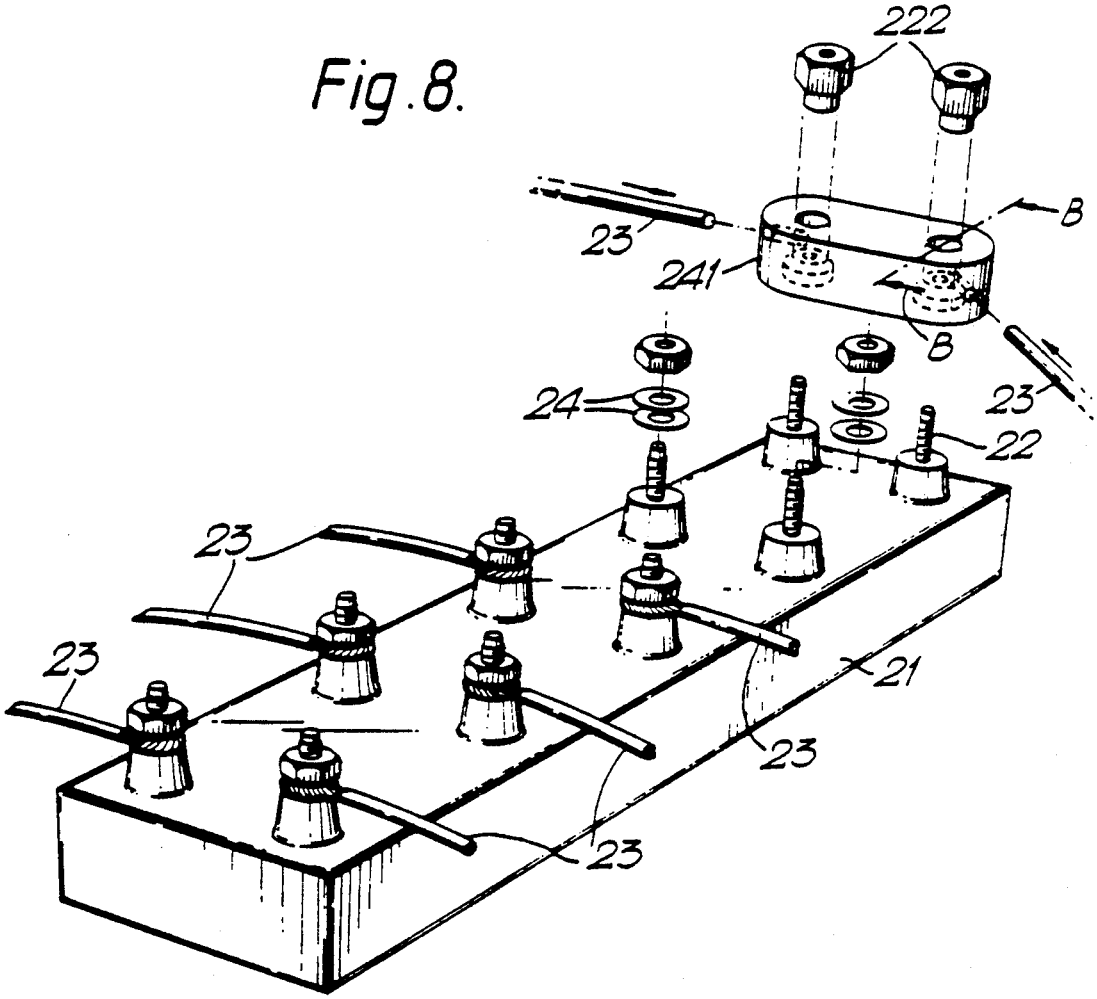
FIG. 8 is a perspective view of an adapter of the second preferred embodiment of the invention on a terminal block, the adaptor being suitable for use over two binding posts.

FIG. 8 (which uses the same reference numbers as above where applicable) illustrates a collar 241 that may be similar to that illustrated in FIG. 7, but has two (and may have more) openings in order that it can be over two (or more) terminal posts, and thus provide means for connection of two (or more) wires to said posts.

Figure 9A:
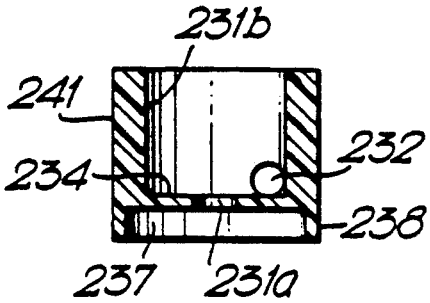
FIGS. 9*a* and 9*b* are cross-sections through the collar illustrated in FIG. 8.
Figure 9B:
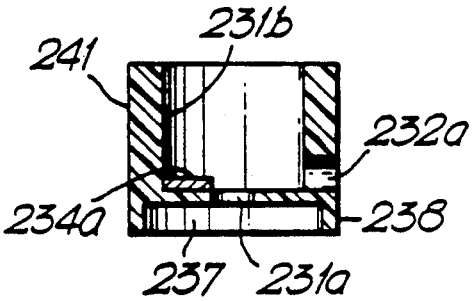

A section through line BB is shown in FIGS. 9*a* and 9*b*. In FIG. 9*a* the shoulder 234 is of uniform height, and the opening 232 lies above it. Thus, a wire in the opening 232 (at the position illustrated) would be cut through if a cap were fully screwed into opening 231*b*. In FIG. 9*b* a portion of collar 234*a* (generally opposite hole 232*a*) is positioned higher than the hole 232 so that a cap is prevented from being screwed so far into the opening 231*b* that severing of the wire would occur. Thus, the adapter can be designed to cut away excess length of a wire, and make contact to the length that remains in the adapter.

Figure 10:
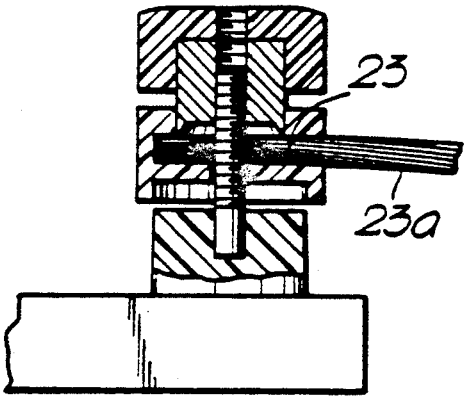
FIG. 10 is a cross section of a collar and cap of the second preferred embodiment of the invention on a binding post.

FIG. 10 shows a cap partially screwed into an adapter.

Figure 11:
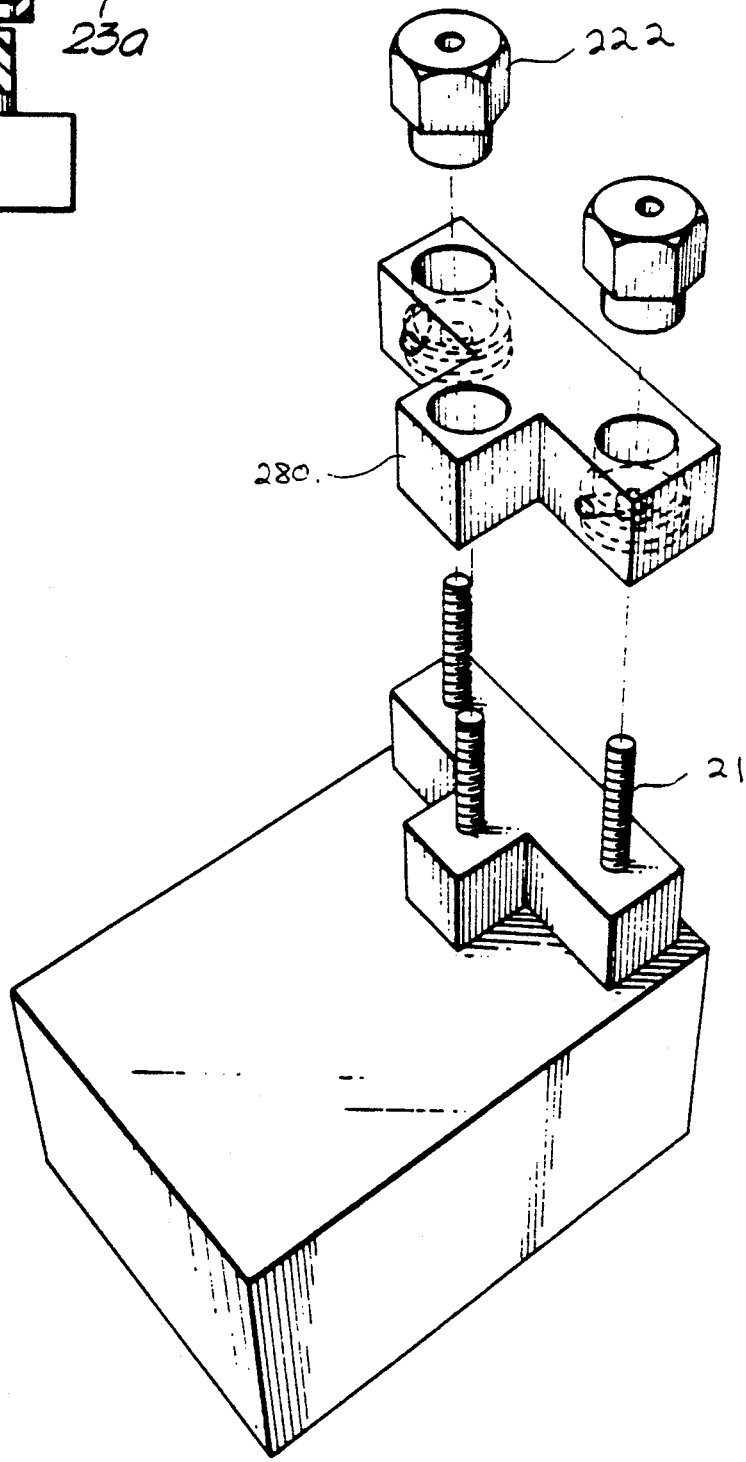
FIG. 11 shows a further application of an adaptor of the second preferred embodiment of the invention.

In FIG. 11 a terminal block of different design is illustrated. Here a collar covers three binding posts 22, two of which are provided with insulating-cutting caps 222 for base member 280.

Figure 12:
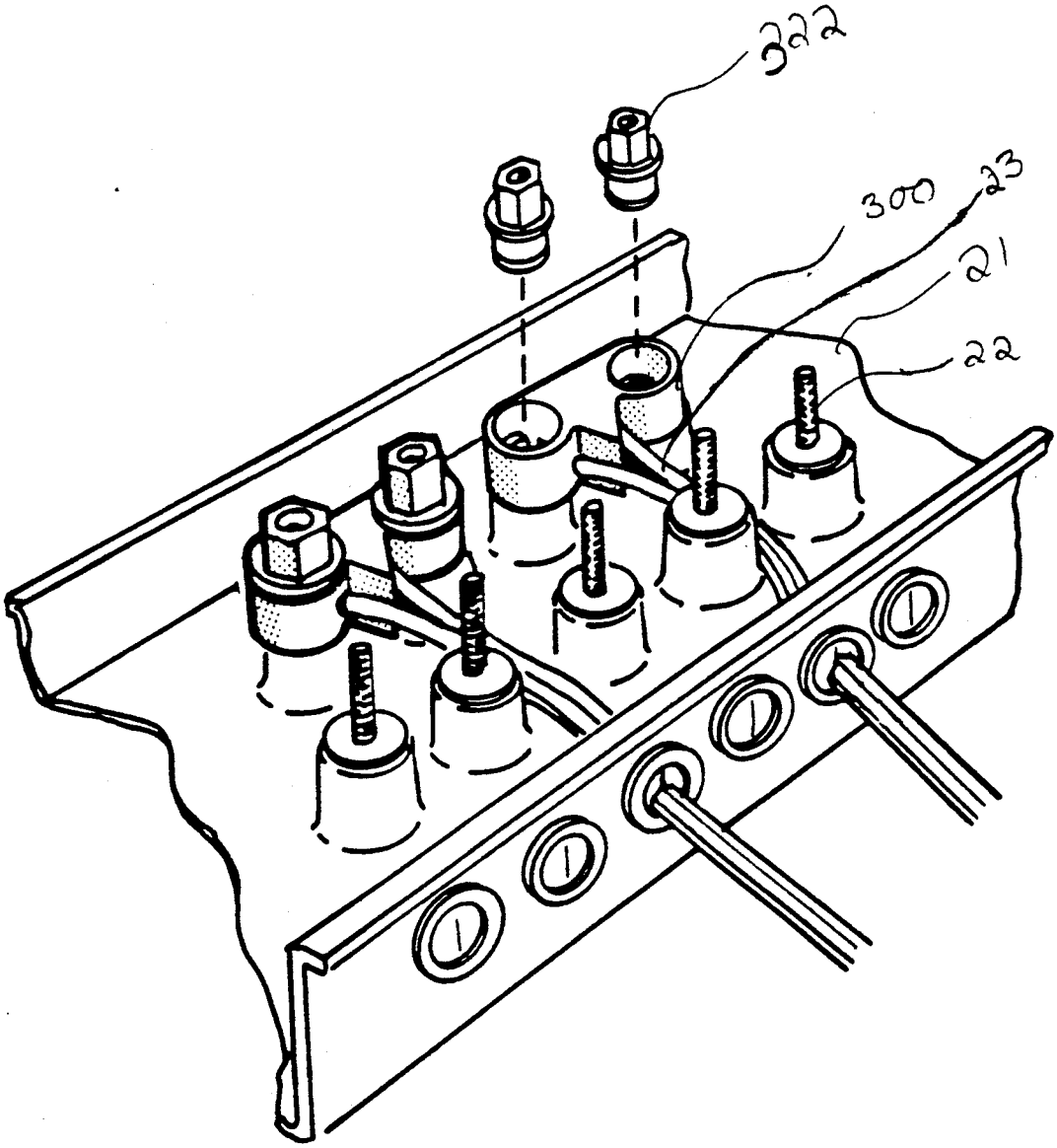
FIG. 12 illustrates a further embodiment of a terminal block adapter.
Figure 13:
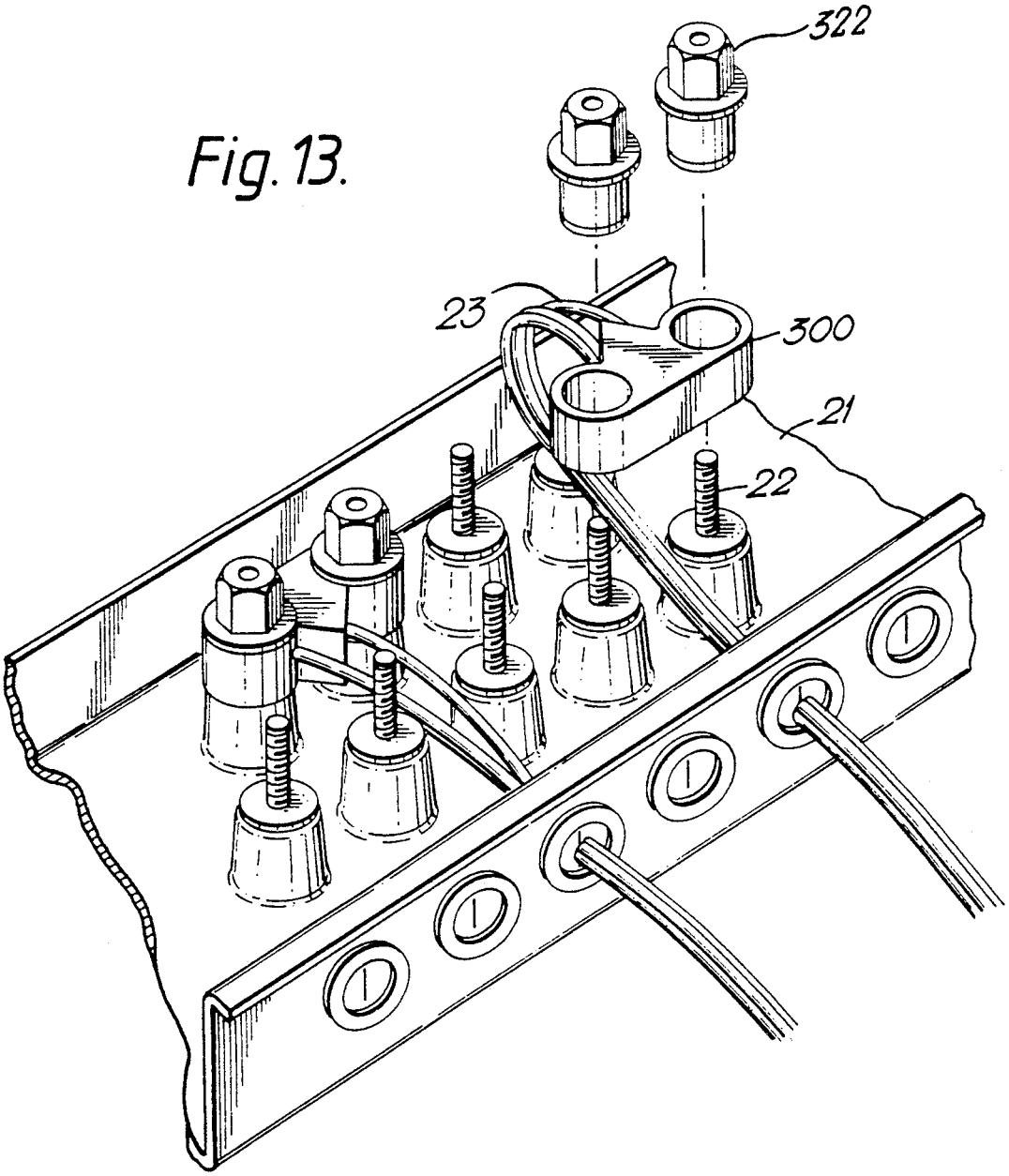
FIG. 13 illustrates the reversible nature of the embodiment of FIG. 12.
Figure 14:
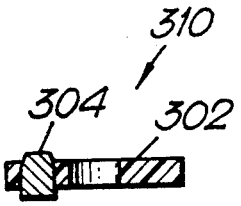
FIGS. 14 through 16 illustrate a washer for use between the adapter and the terminal.
Figure 15:
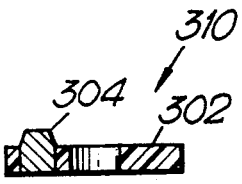
Figure 16:
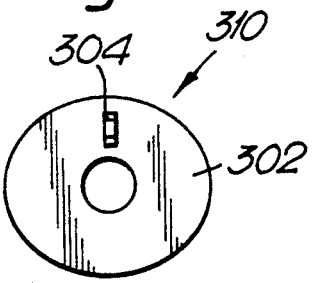

FIGS. 12 and 13 illustrate further adapter embodiments having a body 300 and caps 322. The adapters are configured to work reversibly on the terminal 21 with posts 22 as illustrated. Between the post 22 at its base and the adapter 322 can optionally sit a washer 310, illustrated in FIGS. 14–16. The washer 310 has a washer member 302 with a wedge member 304 of either plastic or metal, as illustrated. When the cap 322 tightens down on the post 22, the wedge is pushed up as illustrated in FIG. 15. This retains the wire in place and provides a metal to metal to metal, i.e., base, wire, cap, contact. Optionally, the washers may be oval in shape to enable a fixed retention place within the base of the adapter in a space provided therefor. For these embodiments, the gel in the cap is preferably about 250 to 325 10-1 mm core penetration. The gel in the adapter is 150 to 250 10-1 mm and the gel between the base and the terminal is about 50 to 200 10-1 mm. Of course, the fewer the types of gel the better but his is a function of gel properties. The washers are formed by injection or other methods known in the art.

Modifications obvious to the ordinary skilled artisan, from a reading of the specification, are within the scope of the invention.

We claim:

1. A terminal block adapter for connecting an insulated wire to a conductive binding post of the terminal block comprising in combination an insulative collar and a threaded cap wherein:

the collar comprises (a) a first opening means therethrough which is smaller in one portion for receiving the binding post from one side of the collar and is larger in another portion for receiving the cap from the opposing side of the collar thereby forming a shoulder in the first opening means proximate to the bottom of the cap when installed whereby the threads in the cap can engage the threads on the binding post and (b) a second opening means in a lateral side thereof, communicating with the first opening means and being positioned laterally opposite from the position of the binding post received in the first opening means, for receiving an insulated wire whereby the wire is positioned by the second opening means at least in part adjacent the binding post and underneath the cap and is engaged by the cap when the cap is threaded on the binding post; and the cap comprises a conductive inner portion and an insulative outer portion wherein the conductive inner portion has thread means adapted to engage the thread means on the binding post and has bottom edge means for engaging the wire positioned in the second opening means of the collar and adjacent the binding post and for compressing the wire against the shoulder means in the first opening means as the cap is tightened on the binding post whereby the edge means contacts a conductor in the wire by passing through the insulation on the wire; and wherein the collar and cap contain cooperative stop means for stopping the advance of the cap on the binding post at a preselected distance between the edge means of the cap and at least the portion of the shoulder means against which the wire is compressed, thereby allowing connection of the edge means of the cap through the insulation of the wire to a conductor in the wire without breaking or severing the wire.

2. A terminal block adapter according to claim 1 wherein the cooperative stop means comprises a shoulder on the cap which engages an outside surface of the collar.

3. A terminal block adapter according to claim 1 wherein the cooperative stop means comprises a portion of the shoulder means in the first opening means which engages the edge means of the cap thereby leaving the desired preselected distance between the edge means of the cap and another portion of the shoulder means where the wire is positioned between the cap and the shoulder means.

4. A terminal block adapter according to claim 1 which comprises a sealing material in at least one of the opening means for environmentally sealing the wire, binding post, or cap.

5. A terminal block adapter according to claim 1 wherein the cap comprises a test for communicating with the conductive inner portion thereof for testing of electrical continuity of the cap and posts with the wire.

6. A terminal block adapter according to claim 1, the adapter being for connecting at least two wires to at least two binding posts, the collar having at least two said first opening means and at least two said second opening means, and at least two said caps.

7. The adapter according to claim 6 wherein the at least two wires are two wires split apart into first and second wires and the first and second wires enter the adapter substantially parallel and on the same side of the adapter.

8. The adapter according to claim 7 wherein a divider separates the first and second wires.

9. The adapter according to claim 8 further including a washer between the binding post and the adapter, said washer including a wedge member capable of retaining the insulation of the wire within the adapter.

10. The adapter according to claim 9 wherein the wedge member is metal and forms a metal base to wire to cap contact.

11. A terminal block for connecting insulated wires to binding posts comprising:

an insulative housing containing a plurality of spaced apart conductive binding posts;

conductive binding posts having opening means therein for receiving the insulated wire; and caps on the binding posts; wherein:

the insulative housing has first opening means therein aligned with the opening means in the binding posts whereby an insulated wire is received through the opening in the housing and into the opening in the binding posts; and the binding posts have thread means for engaging a threaded cap and have first shoulder means positioned between the thread means and the opening means for engaging opposing shoulder means in the cap and have second shoulder means positioned on the opposite side of the opening means which second shoulder means is adapted for supporting the wire when pressure is applied to the wire by the cap threaded onto the binding posts; and the caps have a conductive inner portion and an insulative outer portion wherein the conductive inner portion has thread means adapted to engage the thread means on the binding posts and has shoulder means at the end of said thread means for engaging the first shoulder means of the binding posts and has bottom edge means for engaging the wire positioned in the opening means of the binding posts and compressing the wire against the second shoulder means of the binding posts as the cap is tightened on the binding posts whereby the edge means contacts a conductor in the wire by passing through the insulation on the wire;

wherein the distance between the shoulder means in the cap and the edge means of the cap is such that when the shoulder means in the cap seats against the first shoulder means of the binding posts the distance between the edge means of the cap and the second shoulder means to the binding post is a preselected distance which allows connection of the edge means of the cap through the insulation of the wire to a conductor in the wire without breaking or severing the wire; and wherein the housing has second opening means positioned substantially at right angles to said wire receiving openings through which second opening means the binding posts extends and adapted for receiving the caps therethrough.

12. A terminal block according to claim 11 wherein the cap has conductive means connected with the inner conductive portion which conductive means is accessible through an opening in the outer insulative portion of the cap to provide access for test probe for testing the connection made by the cap.

13. A terminal block according to claim 11 wherein the housing has a base adapted for mounting on a substrate and wherein the binding posts and associated openings in the housing are positioned at an angle of at least 20° from normal to the base to thereby facilitate visibility by the worker when inserting the wires into the opening means.

14. A terminal block according to claim 11 wherein the edge means of the cap is positioned an appropriate distance form the shoulder means in the cap and has an appropriate configuration whereby when the shoulder in the cap engages the first shoulder means of the terminal posts the edge means of the cap makes contact through the insulation to the conductor in a wire of a minimum predetermined size and whereby the edge portion of the cap can engage a conductor in a larger wire through the insulation thereof by compressing the wires against the second shoulder means of the binding posts without severing the wire and without the shoulder means in the cap engaging the first shoulder means of the binding posts when the larger wire is present.

15. A terminal block according to claim 14 wherein the openings in the housing contain a sealant material which is placed under compressive force when the wire is inserted into the opening means in the housing and binding posts and the cap means is advanced against the wire to make connection with a conductor in the wire.

16. A device for electrically connecting an insulated wire to a binding post, which comprises:

(a) an insulative housing having an opening through which a binding post may pass and having another opening through which the insulated wire may pass such that the wire extends into the first-mentioned opening;

(b) a cap having a conductive inner portion, that may be received by the binding post to bring the cap into the first mentioned opening, the cap having bottom edge means that engages a conductor of the wire by passing through insulation of the wire when the cap is thus received by the binding post; and (c) means that limits the extent to which the cap can be received by the binding post thereby preventing the conductor from being broken or completely severed by the bottom edge means.

17. A device according to claim 16, which comprises a terminal block for connecting insulated wires to binding posts comprising:

an insulative housing containing a plurality of spaced apart conductive binding posts;

conductive binding posts having opening means therein for receiving the insulated wire; and caps on the binding posts; wherein:

the insulative housing has first opening means therein aligned with the opening means in the binding posts whereby an insulated wire is received through the opening in the housing and into the opening in the binding posts; and the binding posts have thread means for engaging a threaded cap and have first shoulder means positioned between the thread means and the opening means for engaging opposing shoulder means in the cap and have second shoulder means positioned on the opposite side of the opening means which second shoulder means is adapted for supporting the wire when pressure is applied to the wire by the cap threaded onto the binding posts; and the caps have a conductive inner portion and an insulative outer portion wherein the conductive inner portion has thread means adapted to engage the thread means on the binding posts and has shoulder means at the end of said thread means for engaging the first shoulder means of the binding posts and has bottom edge means for engaging the wire positioned in the opening means of the binding posts and compressing the wire against the second shoulder means of the binding posts as the cap is tightened on the binding posts whereby the edge means contacts a conductor in the wire by passing through the insulation on the wires wherein the distance between the shoulder means in the cap and the edge means of the cap is such that when the shoulder means in the cap seats against the first shoulder means of the binding posts the distance between the edge means of the cap and the second shoulder means of the binding post is a preselected distance which allows connection of the edge means of the cap through the insulation of the wire to a conductor in the wire without breaking or completely severing the wire; and wherein the housing has second opening means positioned substantially at right angles to said wire receiving openings through which second opening means the binding posts extend and adapted for receiving the caps therethrough.

18. A device according to claim 17 wherein the edge means of the cap is positioned an appropriate distance from the shoulder means in the cap and has an appropriate configuration whereby when the shoulder in the cap engages the first shoulder means in the cap and has an appropriate configuration whereby when the shoulder in the cap engages the first shoulder means of the terminal posts the edge means of the cap makes contact through the insulation to the conductor in a wire of a minimum predetermined size and whereby the edge portion of the cap can engage a conductor in a larger wire through the insulation thereof by compressing the wires against the second shoulder means of the binding posts without severing the wire and without the shoulder means in the cap engaging the first shoulder means of the binding posts when the larger wire is present.

19. A device according to claim 18 wherein the openings in the housing contain a sealant material which is placed under compressive force when the wire is inserted into the opening means in the housing and binding posts and the cap means is advanced against the wire to make connection with a conductor in the wire and said cap has conductive means connected with the inner conductive portion which conductive means is accessible through an opening in the outer insulative portion of the cap to provide testing the connection made by the cap.

20. A device according to claim 16 which comprises a terminal block adapter for connecting an insulated wire to a conductive binding post of a terminal block comprising in combination an insulative collar and a threaded cap wherein the collar comprises (a) a first opening means therethrough which is smaller in one portion for receiving the binding post from one side of the collar and is larger in another portion for receiving the cap from the opposing side of the collar thereby forming a shoulder in the first opening means proximate to the bottom of the cap when installed whereby the threads in the cap can engage the threads on the binding post and (b) a second opening means in a lateral side thereof, communicating with the first opening means and being positioned laterally opposite from the position of the binding post received in the first opening means, for receiving an insulated wire whereby the wire is positioned by the second opening means at least in part adjacent the binding post and underneath the cap and is engaged by the cap when the cap is threaded on the binding posts; and the cap comprises a conductive inner portion and an insulative outer portion wherein the conductive inner portion has thread means adapted to engage the thread means on the binding post and has bottom edge means for engaging the wire positioned in the second opening means of the collar and adjacent the binding post and for compressing the wire against the shoulder means in the first opening means as the cap is tightened on the binding post whereby the edge contacts a conductor in the wire by passing through the insulation on the wire; and wherein the collar and cap contain cooperative stop means for stopping the advance of the cap on the binding post at a preselected distance between the edge means of the cap and at least the portion of the shoulder means against which the wire is compressed thereby allowing connection of the edge means of the cap through the insulation of the wire to a conductor in the wire without breaking or completely severing the wire.

21. A device according to claim 20 wherein the cooperative stop means comprises a shoulder on the cap which engages an outside surface of the collar.

22. A device according to claim 20 wherein the cooperative stop means comprises a portion of the shoulder means in the first opening means which engages the edge means of the cap thereby leaving the desired preselected distance between the edge means of the cap and another portion of the shoulder means where the wire is positioned between the cap and the shoulder means.

23. A device according to claim 22 including a sealing material in at least one of the opening means for environmentally sealing the wire, binding post, or cap, and said cap has a test port for communicating with the conductive inner portion thereof for testing of electrical continuity of the cap and posts with the wire.

24. A device according to claim 23 wherein the adapter is capable of connecting at least two wires and comprises at least two binding posts, the collar having at least two said first opening means and at least two said second opening means, and at least two said caps.

* * * * *